United States Patent [19]

Korman

[11] 4,102,086

[45] Jul. 25, 1978

[54] HIDDEN TIERS

[76] Inventor: Richard Thomas Korman, 2800 NE. 24th St., Ft. Lauderdale, Fla. 33305

[21] Appl. No.: 767,646

[22] Filed: Feb. 10, 1977

[51] Int. Cl.[2] ..... E04H 3/12

[52] U.S. Cl. ..... 52/9; 52/183

[58] Field of Search ..... 52/6–10, 52/78, 183, 182, 191

[56] References Cited

U.S. PATENT DOCUMENTS

| | | | |
|---|---|---|---|
| 1,862,824 | 6/1932 | Howard | 52/69 |
| 3,183,558 | 5/1965 | Cronin | 52/182 |
| 3,972,162 | 8/1976 | Lewis | 52/69 |

FOREIGN PATENT DOCUMENTS

| | | | |
|---|---|---|---|
| 1,480,385 | 4/1967 | France | 52/10 |
| 220,829 | 4/1916 | Fed. Rep. of Germany | 52/6 |
| 611,295 | 3/1935 | Fed. Rep. of Germany | 52/6 |
| 109,562 | 1/1944 | Sweden | 52/6 |
| 262,140 | 11/1926 | United Kingdom | 52/9 |

*Primary Examiner*—Ernest R. Purser
*Assistant Examiner*—Henry Raduazo
*Attorney, Agent, or Firm*—Malin & Haley

[57] ABSTRACT

An elevated, tiered seating platform which is convertible to a storage position forming a planar surface, such as a floor. The seating platform includes a pair of rigid support members parallely disposed which have upper surface angled grooves which receive a plurality of planar elongated seating members in the up position. In the storage position, the planar seating members are supported by grooves in a floor in a co-planar manner.

1 Claim, 4 Drawing Figures

HIDDEN TIERS

Hidden Tiers provides a method and a system for convertible seating facilities, covering a wide range of uses, installations, materials and specific designs with both standard and custom fabrications to meet any given specific loading requirements such as bleachers, folding chairs, stack chairs, theater seats, side chairs, tables and chairs in combination etc., which may be altered in form at will by various mechanical means of lifting from a flat surface that will serve as a dance, gymnasium, stage or auditorium floor to various tiers or levels to allow for improved line of sight viewing of various events, shows and theater presentations such that in one instance the closed condition provides a flat useable surface, while the open condition provides level for viewing, thus providing an efficient, practical, economical use of a given room or space for multiple functions, since the tiers are hidden effectively under and as a part of the floor, yet being flush with the surrounding areas as a useable part of that floor.

Figure 1:
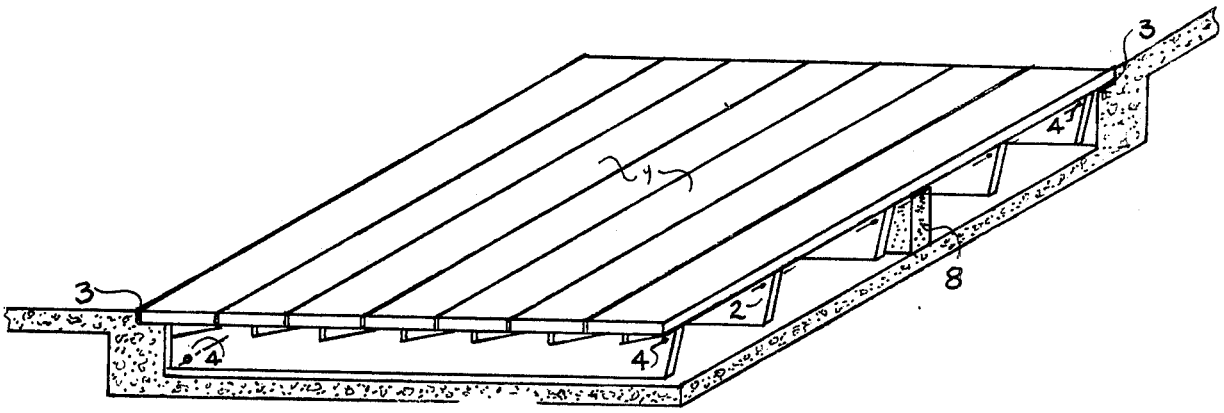
FIG. 1 shows a 16′ × 21′ unit of Hidden Tiers in its down position.
Figure 2:
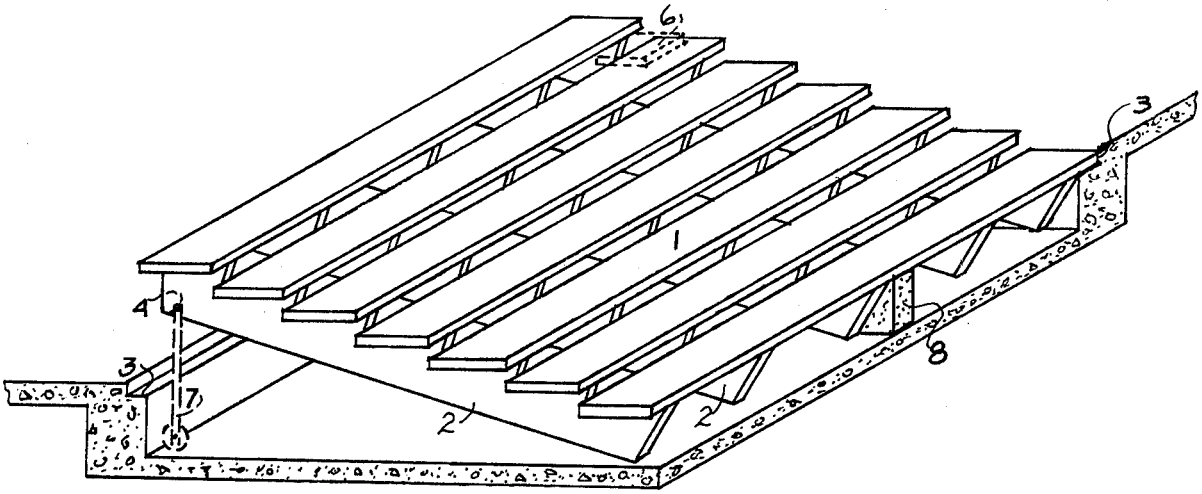
FIG. 2 shows Hidden Tiers in its up position.
Figure 3:
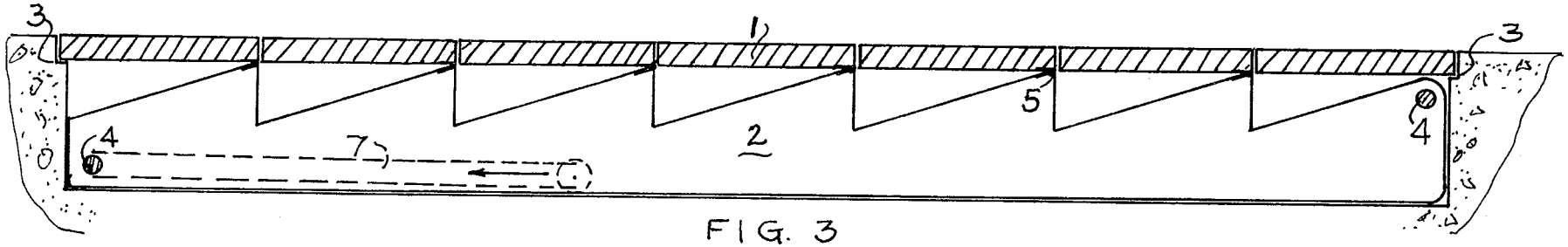
FIG. 3 shows a detail of Hidden Tiers in down position.
Figure 4:
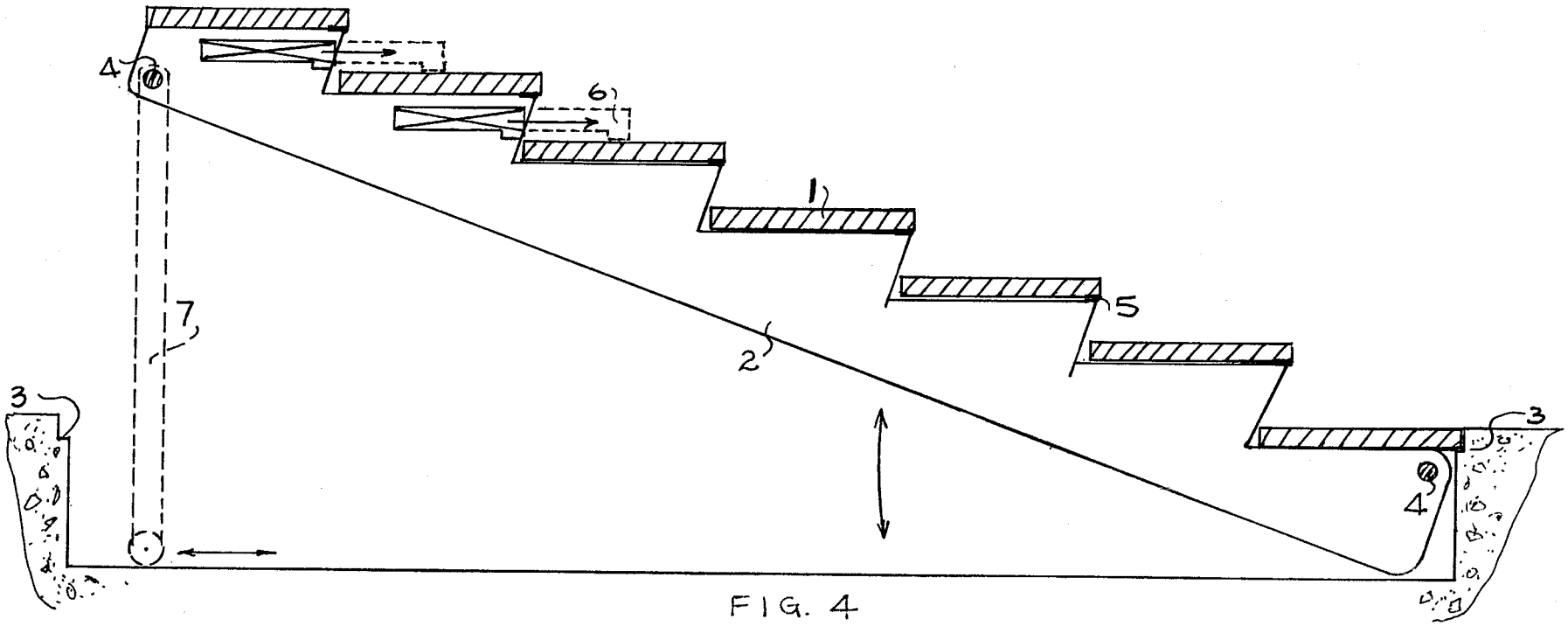
FIG. 4 shows a detail of Hidden Tiers in up position with a detail of the manual or automated intermediate climbing steps.

FIG. 1 of Hidden Tiers shows an entire 16 foot by 21 foot unit in its down position. In this position the unit can be used as normal floor space. The members (item number 1) which make up the flooring space are supported at each end in the down position by recesses in the adjacent floor area (item number 3) and beams (item number 8). As shown in FIG. 2, the floor has a large cavity that receives the entire seating platform in the down position. A recessed lip 3 is disposed around the upper edge of the entire floor cavity that receives and supports the seating members in the down position. Each seating member 1 is an elongated, rectangular, planar surface which is hinged at one edge to the apex of the angled groove formed in the supporting members 2 as shown in FIG. 3. When the seating platform is raised, as shown in FIG. 2, and supported by rigid vertical support members 7, the seating platform members 1 are positioned and supported on the angular grooves formed in the supporting members. In the up position the members are supported by the beams (item number 2). The beams are connected to axels (item number 4) on the front end of the unit to promote their movement. On the back part of the unit is a lifting devise. Any of several lifting devises may be used. While operating, the lift will raise the beams about their respected axels and hinges to a position as shown in FIG. number 2. The members (item number 1) are also hinged on the front side at (item number 5) of the assembly to the proper height and slope as shown in FIG. number 2. The members hinged at point (item number 5) will assume the proper horizantal level enabling them to support chairs, tables, etc. as desired. Intermediate steps (item number 6) can also aid climbing. These steps are to be on tracks and tucked under the members until their use is required. These intermediate steps may be operated as drawers manually or automatically by cam/lever action. (Item number 7) shows one optional method of lifting the unit. (Item number 8) shows additional poured concrete or cement block supports at eight foot intervals for the unit in the down position. All supporting structures to be engineered for each specific loading requirement.

I claim:

1. A convertible seating platform which forms a tiered seating array in a first up position and which is pivotal to a down position forming a floor surface comprising:

a floor having a cavity and a recessed lip around said cavity;

a pair of rigid supporting members disposed in a parallel array, said rigid supporting members having upper surfaces having a plurality of angled grooved portions, each of said grooves having an apex;

a plurality of planar seating members pivotally connected to said supporting members along the upper apex portion of the upper surface of said supporting members; and a moveable means for elevating said supporting members at one end above said floor in a first upper position where one end of each supporting member is elevated above the plane of the floor, said seating member ends engaging the angular surface grooves in the up position and said floor cavity recessed lip in the down position.

* * * * *